US006176521B1

(12) United States Patent
Mancuso

(10) Patent No.: US 6,176,521 B1
(45) Date of Patent: Jan. 23, 2001

(54) VARIABLE COLOR PRINT WITH LOCALLY COLORED REGIONS AND METHOD OF MAKING SAME

(76) Inventor: Robert J. Mancuso, 1 Daniel Dr., Middleboro, MA (US) 02346

( * ) Notice: Under 35 U.S.C. 154(b), the term of this patent shall be extended for 0 days.

(21) Appl. No.: 09/008,357

(22) Filed: Jan. 16, 1998

(51) Int. Cl.[7] ..... B42D 15/00

(52) U.S. Cl. ..... 283/91; 283/85; 283/87; 283/90

(58) Field of Search ..... 283/85, 86, 87, 283/88, 89, 90, 91, 93

(56) References Cited

U.S. PATENT DOCUMENTS

| | | | | |
|---|---|---|---|---|
| 4,033,059 | * | 7/1977 | Hutton et al. | 283/91 |
| 4,588,212 | * | 5/1986 | Catagnoli | 283/91 |
| 4,715,623 | * | 12/1987 | Roule et al. | 283/91 |
| 4,932,685 | | 6/1990 | Mancuso | 283/91 |
| 4,968,064 | | 11/1990 | Mancuso | 283/91 |
| 5,582,103 | * | 12/1996 | Tanaka et al. | 283/91 |
| 5,722,693 | * | 3/1998 | Wicker | 283/91 |

* cited by examiner

*Primary Examiner*—Paul A. Bell
(74) *Attorney, Agent, or Firm*—Iandiorio & Teska

(57) ABSTRACT

A variable color print of an image includes a reflective image medium including a plurality of different, locally colored, image regions; a first plurality of repeated changes in reflective angle of the image medium which extend in a first direction and are parallel to each other in a second direction transverse to the first direction; each locally colored image region including at least one local color medium disposed on the reflective medium; each local color medium includes at least one color sequence, each sequence extending in the second direction and including at least two different color variations; and each color variation is aligned with the repeated changes in reflective angle such that the repeated changes in reflective angle selectively prevent viewing of at least one of the color variations and selectively highlight at least one of the color variations at different viewing angles to generate changes in color of the locally colored image regions as the viewing angle changes.

44 Claims, 9 Drawing Sheets

VARIABLE COLOR PRINT WITH LOCALLY COLORED REGIONS AND METHOD OF MAKING SAME

FIELD OF INVENTION

This invention relates to a color print and method of making same, and more particularly to such a print including a number of different local colored regions having optical variations which selectively permit viewing of one or more local colors at different viewing angles.

BACKGROUND OF INVENTION

A number of different objects display different images, or different views of an image, depending on the angle by which the object is viewed. Some objects, such as holographs, utilize diffraction to separate white light into in its spectral components. A diffraction grating, having 20,000 to 50,000 lines per inch, reflects or transmits different portions of the incident spectrum. The portions are seen as a view of an image which changes as the angle of incidence changes. The process of manufacturing the diffraction grating requires great accuracy and is very expensive.

Rather than utilize the diffraction principal, some objects are provided with embossed foil having far fewer lines per inch which reflects white light as light and dark lines. The reflected lines appear to shift as the viewing angle changes, but changes in color are not produced.

Other embossed objects are printed on with different colors. The arrangement of the printed pigments in relation to embossed lines can establish a moire pattern which interferes with the intended image. For some prints the objectionable moire patterns must be overcome by printing different colors as dots at a different periodicity or angle than the periodicity or angle of the embossed pattern.

Yet other objects utilize a lenticular construction in combination with color pigments. Lenticular films have a number of tiny, semi-cylindrical lenses, known as lenticules, which are typically formed as parallel ridges embossed on the base side of the film. The lenticules extend in parallel across the entire surface of the film and alter the manner in which the underlying emulsion is exposed by the subject, and any intervening, color filters.

Lenticular films are often used to generate a stereoscopic effect by revealing left and right images as the viewing angle changes. A lenticular print can similarly be made through printing techniques using half-tone dots. However, individual regions of the image are not oriented so that the colors change according to the viewing angle.

Yet other objects, such as those disclosed in U.S. Pat. Nos. 4,932,685 and 4,968,064, utilize embossed film in which periodic variation in an optical characteristic of the medium extends in a given direction for a particular region of a given image. Each region is distinguished from any adjacent region in that the optical characteristic is oriented differently. However, this process can be very expensive in that it requires each image to be individually engraved. Further, it requires registration of the color image printed upon the embossed medium with the locally engraved regions.

SUMMARY OF INVENTION

It is therefore an object of this invention to provide an improved multi-colored variable color print which includes a number of locally colored image regions which readily change color as the viewing angle changes.

It is a further object of this invention to provide such a variable color print which can be formed on mass produced embossed stock.

It is a further object of this invention to provide such a variable color print which does not require individual engraving of each image.

It is a further object of this invention to provide such a variable color print which can be printed using common printing techniques but yielding uncommon color images.

It is a further object of this invention to provide such a variable color print which does not require registration between the locally colored regions and the periodic optical variations of the image medium.

It is a further object of this invention to provide such a variable color print which is inexpensive to produce.

It is a further object of this invention to provide an improved method of forming such a variable color print.

The invention results from the realization that a visually pleasing and intriguing image having variable colors can be achieved by constructing a print having periodic color variations in an optical characteristic, such as variations in transmissivity or reflective angle, which are generally parallel to each other within a number of adjacent local image regions, each local image region being differently, locally colored in relation to each adjacent image region, and the print further including periodic variations in color generally aligned with periodic optical variations within each region so that one or more of the colors are selectively subdued or hidden at different viewing angles while one or more of the remaining colors are revealed or highlighted to generate changes in color or intensity of color of the viewed image.

This invention features a variable color print of an image having a reflective image medium including a plurality of different, locally colored, image regions, a first plurality of repeated changes in reflective angle of the image medium which extend in a first direction and are parallel to each other in a second direction transverse to the first direction, each locally colored image region includes at least one local color medium disposed on the reflective medium, each local color medium includes at least one color sequence, each sequence extending in the second direction and including at least two different color variations. Each color variation is aligned with the repeated changes in reflective angle such that the repeated changes in reflective angle selectively prevent viewing of at least one of the color variations and selectively highlight at least one of the color variations at different viewing angles to generate changes in color of the locally colored image regions as the viewing angle changes.

In a preferred embodiment the color variations may be aligned within the locally colored image regions for providing at least two different colors, each in a different locally colored image region, visible for each viewing angle. The image medium may include a substrate and reflective material disposed on the substrate. The repeated changes in reflective angle may include undulations in the reflective surface of the image medium. The undulations may be oriented in the same direction for each image region. The undulations may be generally sinusoidal. The undulations may include a plurality of grooves established in the reflective surface. The undulations may include a plurality of raised, semi-spherical dots. The undulations may be substantially regularly spaced. The color variations may be regular in at least two of the locally colored image regions. There may be at least two repeated variations in color associated with each repeated change in reflective angle. The repeated changes in reflective angle may prevent viewing of the two different colors at a different viewing angle and enable viewing of two other colors. The reflective image medium may include at least 65 repeated reflective changes per inch. The reflective image medium may include 100 to 300 repeated reflective changes per inch. The different locally colored image regions may represent different intensities of the image. The repeated variations in color may be disposed on the undulations of the reflective surface. There may be a second plurality of repeated changes in reflective angle of the image medium which extend in a third direction transverse to the first direction and which are parallel to each other in a fourth direction transverse to the second direction. The third direction may be perpendicular to the first direction. The repeated changes in reflective angle may include undulations in the reflective surface of the image medium. The undulations may include a plurality of raised, semi-spherical dots.

The invention also features a variable color print of an image having a reflective image medium including a plurality of different, locally colored, image regions, a first plurality of repeated changes in reflective angle of the image medium which extend in a first direction and are parallel to each other in a second direction transverse to the first direction, a second plurality of repeated changes in reflective angle of the image medium which extend in the second direction and are parallel to each other in the first direction transverse to the second direction. Each locally colored image region includes at least one local color medium disposed on the reflective medium, each local color medium includes at least one color sequence, each sequence including at least two different color variations extending in the first and second directions. At lest one of the color variations is aligned with the repeated changes in reflective angle such that the repeated changes in reflective angle selectively prevent viewing of at least one of the color variations and selectively highlight at least one of the color variations at different viewing angles to generate changes in color of the locally colored image regions as the viewing angle changes.

The invention also features a variable color print of an image having a translucent image medium including a plurality of different, locally colored, image regions, a first plurality of repeated changes in transmissivity of the image medium which extend in a first direction and are parallel to each other in a second direction transverse to the first direction. Each locally colored image region includes at least one local color medium disposed on the translucent image medium, each local color medium includes at least one color sequence, each sequence extending in the second direction and including at least two different color variations, and each color variation is aligned with the repeated changes in transmissivity such that the repeated changes in transmissivity selectively prevent viewing of at least one of the color variations and selectively highlight at least one of the color variations at different viewing angles to generate changes in color of the locally colored image regions as the viewing angle changes.

In a preferred embodiment the color variations may be aligned within the locally colored image regions for providing at least two different colors, each in a different locally colored image region, visible for each viewing angle. The image medium may include a transmissive substrate and reflective material disposed on the substrate. The repeated changes in transmissivity may include undulations in the translucent surface of the image medium. The undulations may be oriented in the same direction for each image region. The undulations may be generally sinusoidal. The undulations may include a plurality of grooves established in the translucent surface. The undulations may include a plurality of raised, semi-spherical dots. The undulations may be substantially regularly spaced. The color variations may be regular in at least two of the locally colored image regions. There may be at least two repeated variations in color associated with each repeated change in transmissivity. The repeated changes in transmissivity may prevent viewing of the two different colors at a different viewing angle and enable viewing of two other colors. The translucent image medium may include at least 65 repeated transmissivity changes per inch. The translucent image medium may include 100 to 300 repeated transmissivity changes per inch. The different locally colored image regions may represent different intensities of the image. The repeated variations in color may be disposed on the undulations of the translucent surface. There may be a second plurality of repeated changes in transmissivity of the image medium which extend in a third direction transverse to the first direction and which are parallel to each other in a fourth direction transverse to the second direction. The third direction may be perpendicular to the first direction. The repeated changes in transmissivity may include undulations in the translucent surface of the image medium. The undulations may include a plurality of raised, semi-spherical dots.

The invention also features a variable color print of an image including a reflective image medium including a plurality of different, locally colored, image regions, and a first plurality of repeated changes in reflective angle of the image medium which extend in a first direction and are parallel to each other in a second direction transverse to the first direction. Each locally colored image region includes at least one local color medium disposed on the reflective medium and each local color medium includes at least one color sequence. Each sequence includes a first color variation extending in the first direction and aligned with the repeated changes in reflective angle and a second color variation extending transverse to the first color variation such that the repeated changes in reflective angle selectively prevent viewing of at least a portion of the color variations and selectively highlight at least a portion of the color variations at different viewing angles to generate changes in color of the locally colored image regions as the viewing angle changes.

The invention also features a variable color print of an image including a translucent image medium including a plurality of different, locally colored, image regions, and a first plurality of repeated changes in transmissivity of the image medium which extend in a first direction and are parallel to each other in a second direction transverse to the first direction. Each locally colored image region includes at least one local color medium disposed on the translucent image medium and each local color medium includes at least one color sequence. Each sequence includes a first color variation extending in the first direction and aligned with the repeated changes in transmissivity and a second color variation extending transverse to the first color variation such that the repeated changes in transmissivity selectively prevent viewing of at least a portion of the color variations and selectively highlight at least a portion of the color variations at different viewing angles to generate changes in color of the locally colored image regions as the viewing angle changes.

The invention also features a method of printing a variable color print by designating local image regions of an image, defining at least two different colors, each color including at least two color sequences, each sequence including at least two different color variations which extend in a first direction, assigning the colors to the local image regions, and printing the color sequences assigned to the local image regions onto an embossed medium having a plurality of repeated changes in reflective angle or transmissivity which extend in a second direction and which are parallel to each other in the first direction transverse to the second direction, each color variation aligned with the repeated changes in reflective angle or transmissivity such that the repeated changes in reflective angle or transmissivity selectively prevent viewing of at least one of the color variations and selectively highlight at least one of the color variations at different viewing angles to generate changes in color of the local color image regions as the viewing angle changes.

The invention also features a computerized system for producing a variable color print including means for providing an image to be printed, data entry means, means for defining at least two different colors, each color including at least two color sequences, each sequence including at least two different color variations which extend in a first direction, means for designating local image regions of the image to create an object mask, means for assigning said at least two different colors to the local image regions, means, responsive to the data entry means, for selecting print attributes of the variable color print, means for producing individual color masks of the image, and means, responsive to the means for defining, for printing the individual color masks onto an embossed medium having a plurality of repeated changes in reflective angle or transmissivity which extend in a second direction and are parallel to each other in the first direction transverse to the second direction, each color variation being aligned with the repeated changes in reflective angle or transmissivity such that the repeated changes in reflective angle or transmissivity selectively prevent viewing of at least one of the color variations and selectively highlight at least one of the color variations at different viewing angles to generate changes in color of the local image regions as the viewing angle changes.

In a preferred embodiment, the means for assigning may include copy means for making three copies of said color variation. The means for assigning may include means for shifting each copy. The copy means may include means for increasing the resolution of each copy. The means for selecting may include map means for creating a bit map of each copy. The means for producing may include means, responsive to the individual masks, for creating a composite mask.

DISCLOSURE OF PREFERRED EMBODIMENT

Other objects, features and advantages will occur to those skilled in the art from the following description of a preferred embodiment and the accompanying drawings, in which.

The invention is directed to a variable color print having a number of differently colored adjacent regions, each region typically having the same periodic variations in an optical characteristic. Each region is associated with a local color which distinguishes it from an adjacent region. Each local color includes a defined color sequence, each sequence including color variations which are generally aligned with the periodic optical variations such that a change in viewing angle hides, subdues, or highlights one or more of the sequenced colors.

The periodic optical variations may take the form of repeated changes in reflective angle, such as grooves or undulations embossed in a reflective foil medium, or as cyclic variations in transmissivity such as may be found in a translucent medium.

Moreover, the invention encompasses a method of forming such a variable color print without requiring special engraving or registration of the image with the embossed medium. Reflective foil stock, or translucent stock, having a generally uniform designated line or dot pattern embossed thereon may be printed on by assigning colors to local image regions. The locally colored image regions establish a mask. Each locally colored image region includes a defined sequence of color variations such that when the mask is transferred to the embossed image medium and aligned with the embossing, a change in viewing angle selectively prevents, subdues, or highlights at least one of the color variations in each region, changing the color perceived by an observer. When printing on a translucent medium, discussed in more detail with reference to FIG. 8, the image is typically printed on the side opposite from the embossing, however, this is not a necessary limitation of the invention.

Figure 1:
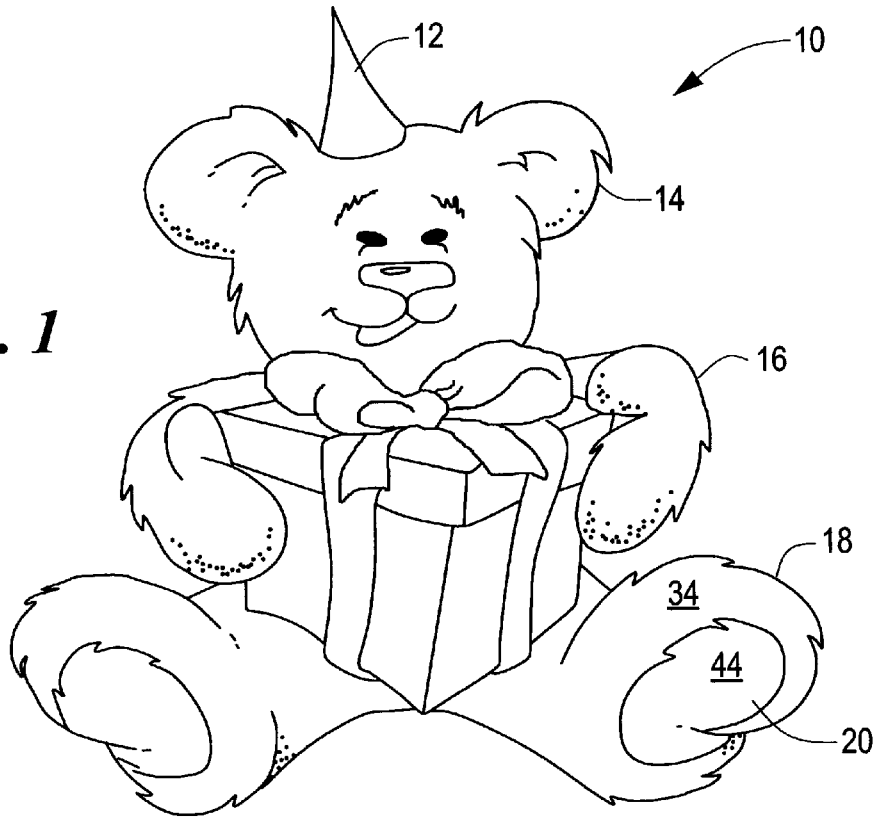
FIG. 1 is schematic top plan view of a variable color print according to this invention generated by several adjacent and differently colored local regions.

Variable color print 10 depicting the image of a "Teddy" bear, FIG. 1, includes a number of adjacent, locally colored image regions. A portion of variable color print 10 is defined in part by local image regions 12, 14, 16, 18 and 20. Each local region is defined by a local color, for example local color 34, which defines the bear's foot, and local color 44 which defines the foot pad.

Figure 2:
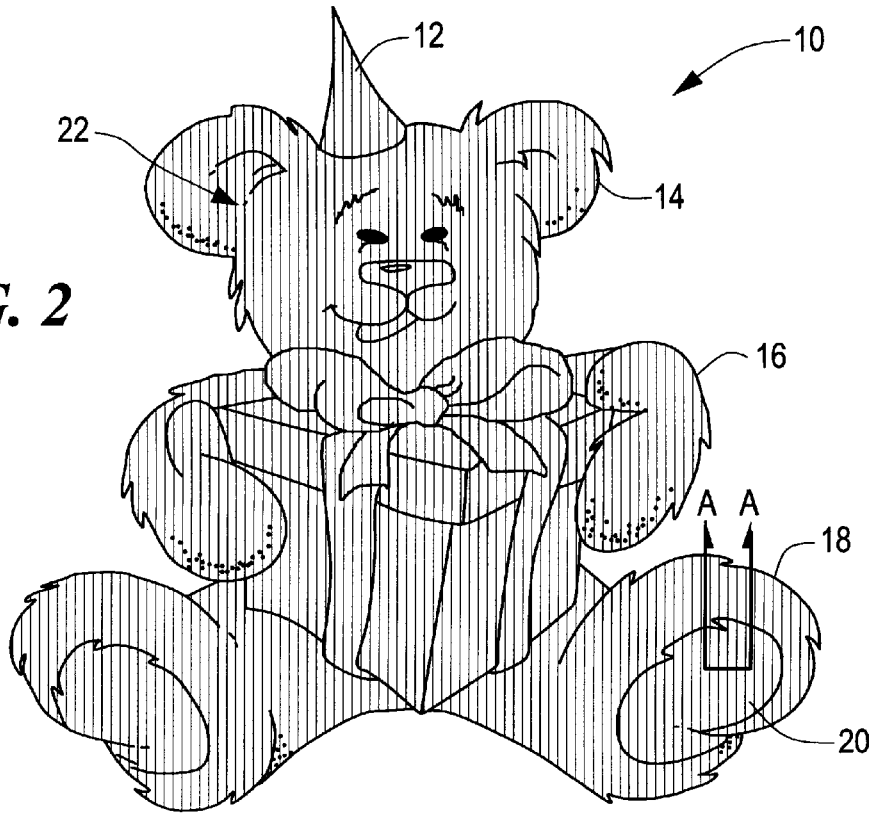
FIG. 2 is a schematic top plan view of the variable color print of FIG. 1 showing the orientation of lines which are representative of the periodic optical variations of the image medium in adjacent local regions.

Local image regions 12, 14, 16, 18 and 20, FIG. 2, each have lines 22 which are representative of repeated optical variations in the image medium extending in a first direction and which are parallel to each other in a second direction, transverse to the first direction. Requiring the lines to be oriented in the same direction in all adjacent image regions alleviates the need to register the print with differently oriented embossed lines of individual image regions and no special engraving is necessary. Lines 22 are shown enlarged for the sake of explanation, but are typically present at a frequency of 65 to 300 lines per inch. However, this is not a necessary limitation of the invention, as the number of lines per inch are determined by the resolution of the image and the ability to technically produce the image. Using less than 65 lines per inch results in a coarse image while using more than 300 lines per inch makes the image difficult to produce.

Figure 3:
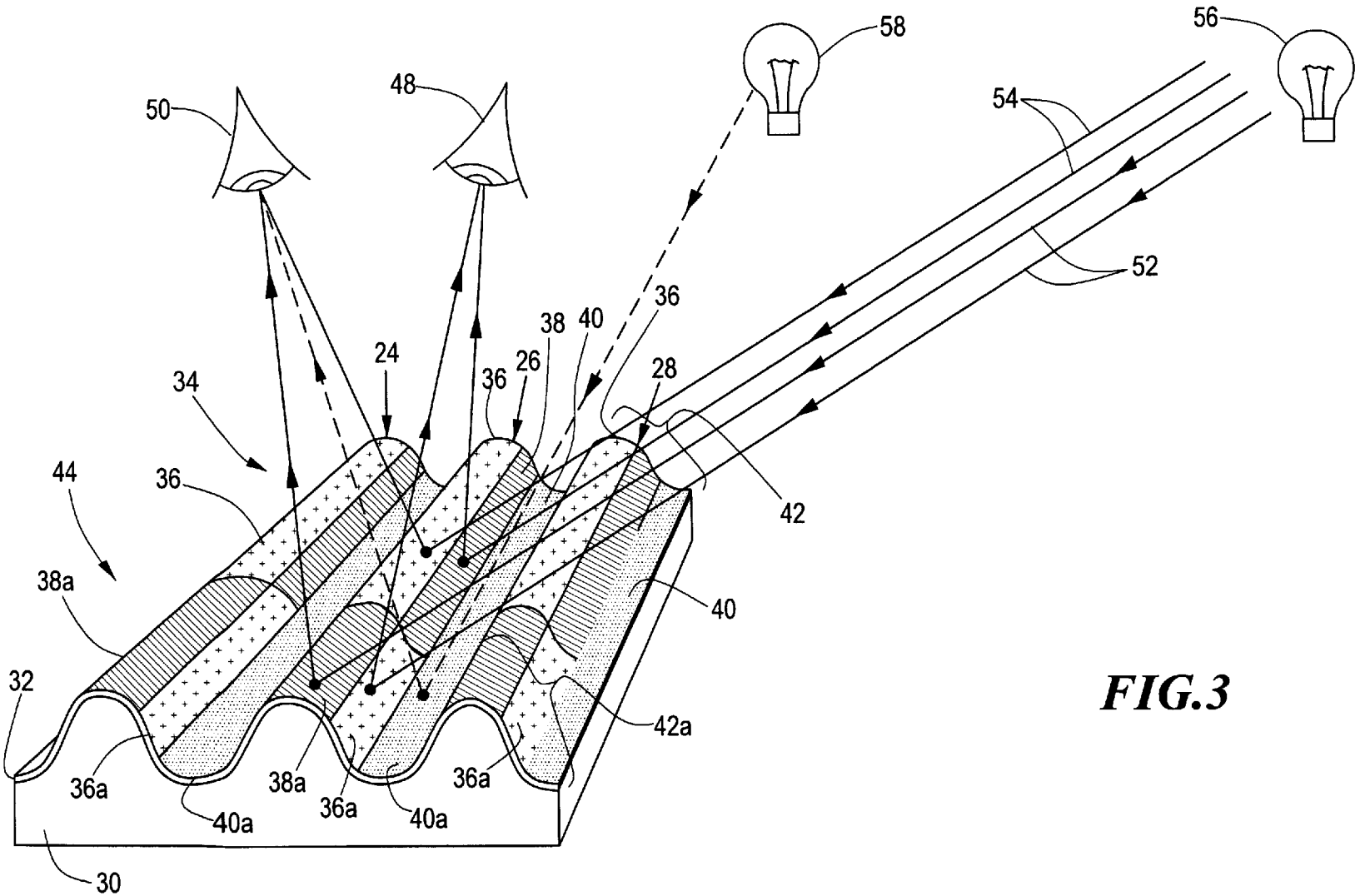
FIG. 3 is a greatly enlarged schematic axonometric view along a portion of line A—A of FIG. 2 showing embossed grooves and aligned colors assigned to adjacent local color regions which are selectively subdued and revealed at different viewing angles.

The lines are established in the construction by periodic grooves 24, 26, and 28, FIG. 3, which is a greatly enlarged view taken along line A—A of FIG. 2. Grooves 24, 26 and 28 are established in substrate 30 such as by heat transfer debossing of reflective foil 32 onto substrate 30 to produce a reflective surface. Local color 34, assigned to a local image region, is then printed onto foil 32 in general alignment with grooves 24, 26 and 28, which, because of reflective foil 32, serve as repeated changes in reflectivity that selectively hide or reveal color variations 36–40 as the viewing angle changes resulting in preventing, subduing and highlighting color variations 36–40.

Local color medium 34 includes a sequence 42 of color variations consisting of yellow stripes 36, magenta stripes 38 and cyan stripes 40. In contrast, local color 44 includes a sequence 46 of color variations consisting of magenta stripes 38*a*, yellow stripes 36*a* and cyan stripes 40*a*, for example. However, this is not a necessary limitation of the invention as only one of the three variations need to be aligned with the embossing as discussed in greater detail with reference to FIG. 3A. The stripes are spaced at the same frequency or multiples of the frequency of the grooves, typically 65 to 300 lines per inch as discussed above, so that they will align with the grooves. For example, the stripes may be aligned with the grooves and spaced at one half, the same as, or twice the frequency of the grooves. Other colors including black and white may also be used in addition to or in place of yellow, magenta and cyan stripes in order to darken or lighten the colors.

As the image is viewed from the positions of observers 48 and 50 in relation to light rays 52 and 54 from light source 56, groove 26 reflects primarily magenta light from magenta stripe 38 of local color 34 and yellow light from yellow stripe 36*a* of local color 44 as illuminated by light rays 52 and perceived by observer 44.

In contrast, the cyan color stripe 40 as illuminated by light ray 54 is reflected at a different angle which is not perceived by observer 50. As the viewing angle shifts to the position of observer 50, the yellow color is perceived instead of the magenta color of local color 34 and the magenta color is perceived instead of the yellow color of local color 44 from groove 26.

A different angle may also be achieved by shifting the light source to the position occupied by light source 58. At this viewing angle an observer at position 50 would observe two contrasting intensities of cyan color. Although cyan is the most strongly reflected, there is some reflection of yellow from local color 34 and magenta from local color 44, thus the local regions 18 and 20, FIG. 1, are distinguishable.

Figure 3A:
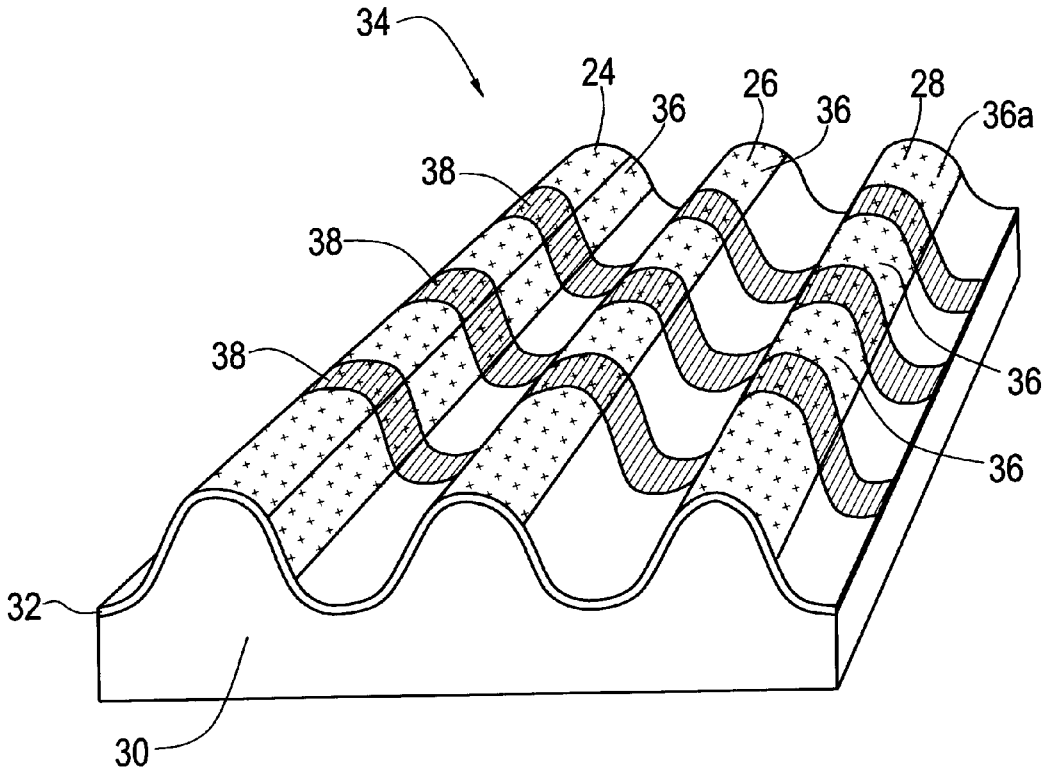
FIG. 3A is greatly enlarged schematic, similar to FIG. 3, in which one color variation runs parallel with the embossing and one color variation runs transverse to the embossing.

Alteratively, only one of the color variations for example yellow stripe 36, FIG. 3A, need be aligned with grooves 24, 26, and 28. By providing only one color variation as the viewing angle changes the intensity of the color variation will change. For example, if only yellow stripes are used, as the viewing angle changes, the intensity of the yellow color 34 perceived will vary from pale yellow to a deep yellow. Similarly, if only a cyan stripe is used, the color perceived will vary from pale blue to deep blue as the viewing angle changes, and so on.

Additionally, magenta stripes 38 may lie transverse to grooves 24, 26, 28 and yellow stripes 36 so that as the viewing angle changes the color perceived will change as discussed above with reference to FIG. 3.

Figure 4:
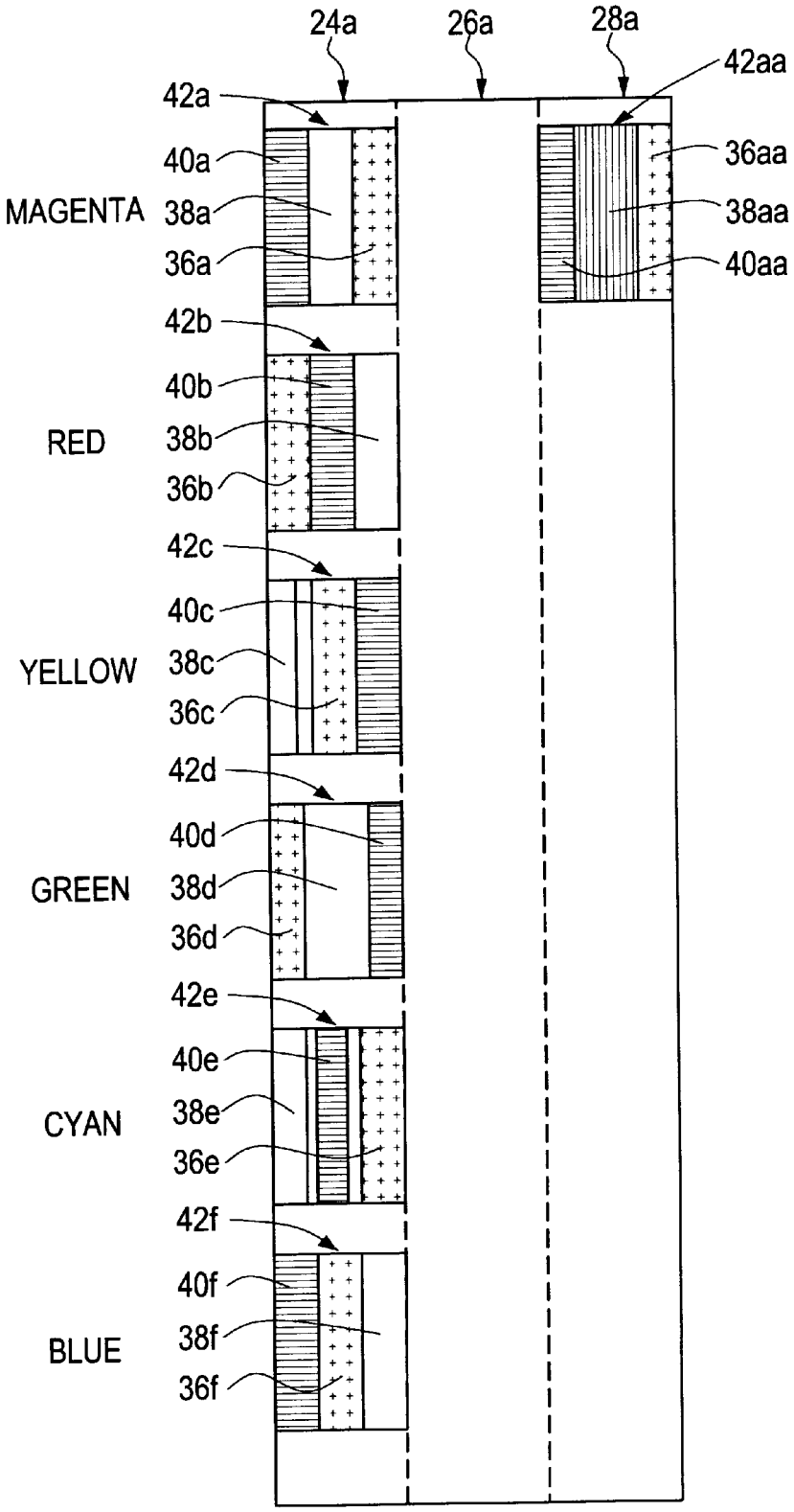
FIG. 4 is a greatly enlarged view of a straight line engraving showing different color sequences and line widths which may be used to vary intensity and color of adjacent local colored regions.

The primary color observed at a given viewing angle is defined by the width of the color stripes which make up the local color medium and the sequence in which the stripes are arranged when aligned with grooves 24, 26, 28, FIG. 4. For example, when viewed from the same angle, sequences 42*a*, 42*b*, 42*c*, 42*d*, 42*e* and 42*f*, (defined by stripes 36*a–f*, 38*a–f* and 40*a–f* aligned with groove 24*a*), may represent local color mediums perceived as the colors magenta, red, yellow, green, cyan and blue, respectively. As the viewing angle changes, the most strongly reflected color stripe also changes thereby changing the particular local color perceived. For example, a local color perceived as magenta at one angle may be perceived as blue at a different angle or green at yet another angle. Moreover, by changing the width of the stripes 36*aa*, 38*aa*, and 40*aa* of sequence 42*aa* aligned with groove 28*a*, a different intensity of magenta will be perceived. Similarly, as the viewing angle changes, the intensity of the perceived color will likewise change.

Figure 5:
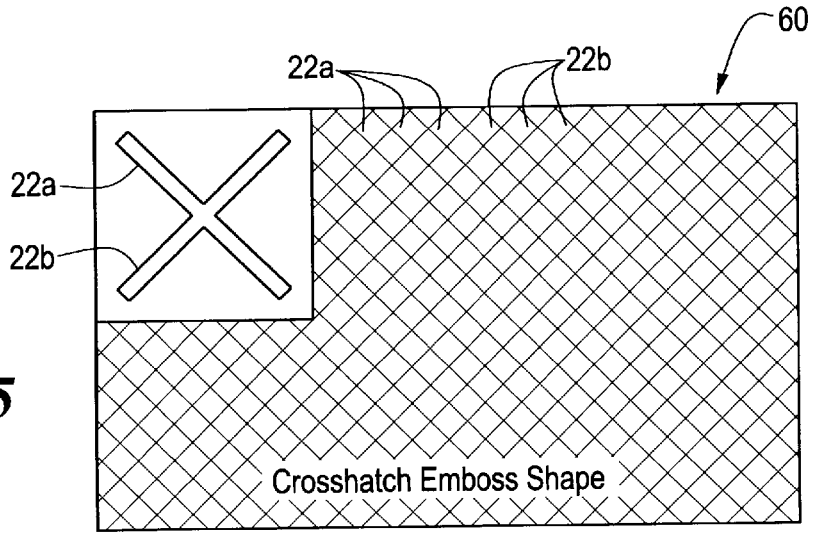
FIG. 5 is an enlarged schematic view of a crosshatched embossed groove pattern representative of the periodic optical variations of the image medium in all local image regions.

In addition to grooves or undulations 24, 26, 28, FIG. 3, which are typically, but not necessarily, sinusoidal in nature, the embossed lines may also consist of crosshatch lines 60, FIG. 5. Crosshatch pattern 60 consists of lines 22*a* which extend in one direction and are parallel to each other in a second direction transverse to the direction of extension, and lines 22*b* which extend in a direction transverse to lines 22*a* and are parallel to each other along lines 22a. Lines 22*a* and 22*b* may cross at 90 degrees to produce squares or at various angles to produce diamond shapes.

Figure 6A:
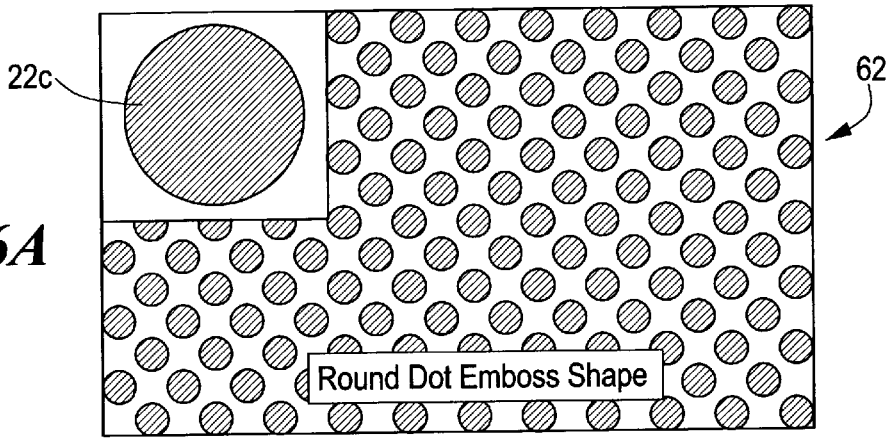
FIG. 6A is an enlarged schematic view of a semi-spherical embossed dot pattern representative of the periodic optical variations of the image medium in all local image regions in which the dots are uniformly spaced.
Figure 6B:
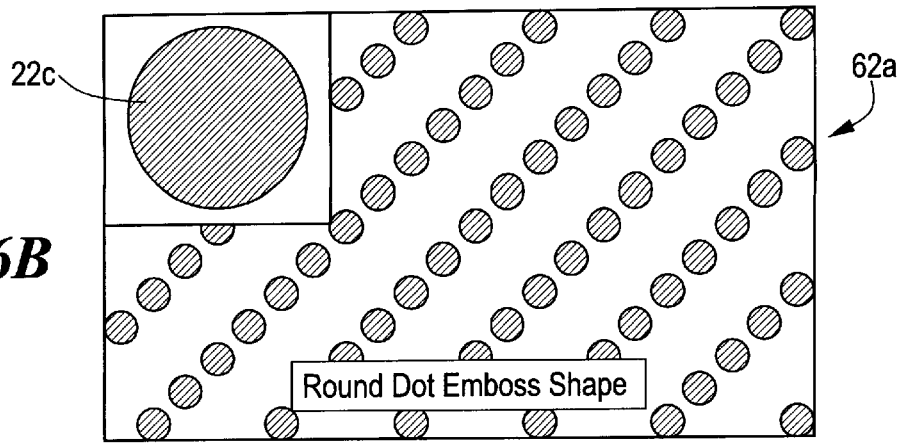
FIG. 6B is an enlarged schematic view, similar to FIG. 6A, in which the semi-spherical dots form parallel lines.
Figure 6C:
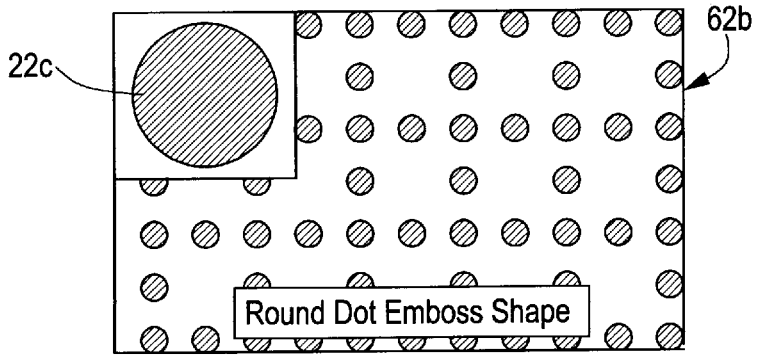
FIG. 6C is an enlarged schematic view, similar to FIG. 6A, in which the semi-spherical dots from a crosshatch pattern representative of the periodic optical variations of the image medium in all local image regions.

The embossing may also take the form of semi-spherical dots 22*c*, FIG. 6A which also lessens the intensity of the local colors perceived. Dots 22*c* may be uniformly spaced 62 to produce a pebbled surface, or they may extend in one direction to form lines 62*a*, FIG. 6B, each line spaced apart and parallel, similar to lines 22, FIG. 4. Similarly, dots 22*c*, FIG. 6C may be arranged to form a pebbled crosshatch pattern 62*b*, similar to crosshatch pattern 60, FIG. 5. The embossing may, however, be any shape such as embossed elliptical and even irregular shapes that repeat at regular intervals.

Figure 7:
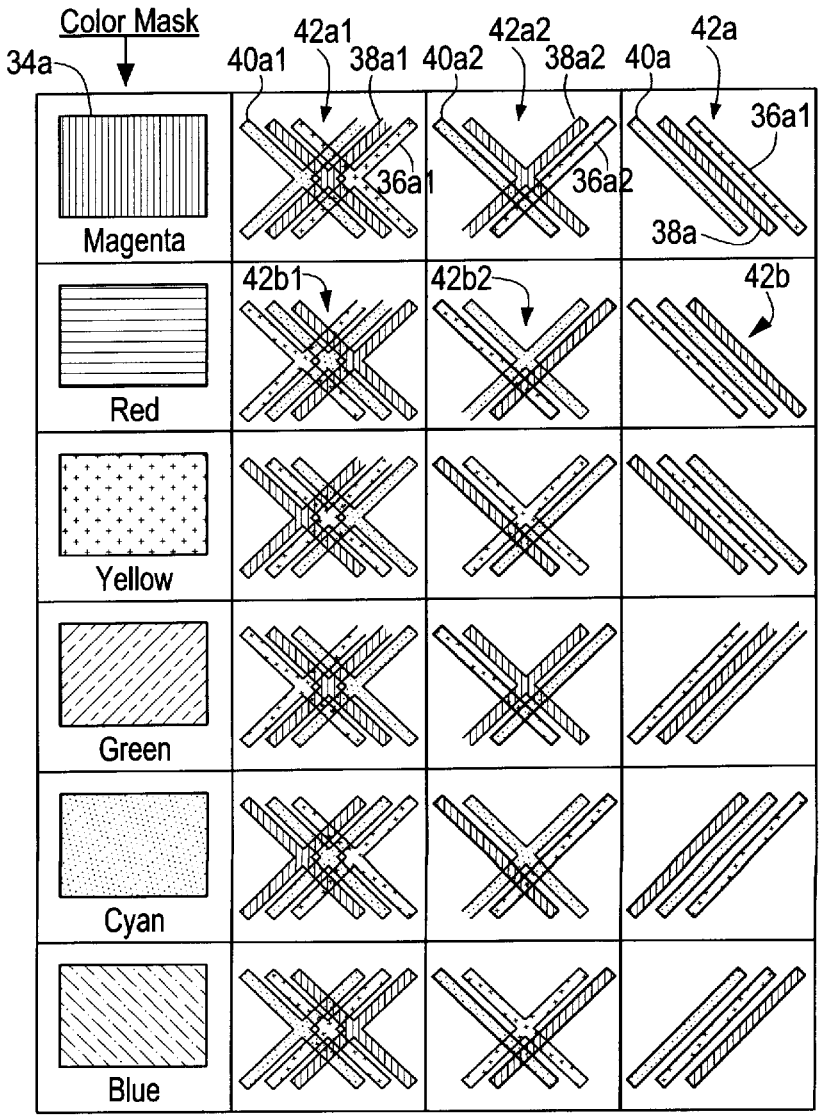
FIG. 7 is an enlarged schematic view of crosshatched color variation patterns which can be aligned with and printed upon embossed crosshatch grooves or embossed dot patterns to selectively subdue and reveal color variations as the viewing angle changes.

Crosshatched color variations may be utilized to provide essentially two viewing angles. The crosshatch pattern comprises different combinations of yellow, magenta, and cyan color stripes. For example, magenta 34*a*, FIG. 7, may be represented by color sequence 42*a*1, magenta crosshatch stripes 38*a*1, cyan crosshatch stripes 40*a*1, and yellow crosshatch stripes 36*a*1. Alternatively, magenta may be represented by sequence 42*a*2 which includes cyan stripe

40*a*2, magenta crosshatch 38*a*2 and yellow stripe 36*a*2. Yet another alternative is to use sequence 42*a* as discussed above with reference to FIG. 4 which consists of cyan stripe 40*a*, magenta stripe 38*a* and yellow stripe 36*a*. Red, yellow, green, and blue may be represented in a similar manner.

The intensity of each local color will vary depending on the sequence 42*a*, 42*a*1, or 42*a*2 chosen. Further, as discussed above with reference to FIG. 4, the intensity may also be varied by adjusting the width of the cyan, magenta and yellow stripes. Thus, the sequences 42*a*-42*a*2 may be aligned with crosshatch pattern 60, FIG. 5, dot pattern 62, FIG. 6A, dot line pattern 62*a*, FIG. 6B, and dot crosshatch pattern 62*b*, FIG. 6C, as well as with grooves 24, 26, 28, FIG. 3. Further, depending on the spacing between the embossed patterns, the crosshatch variations may be aligned with either the grooves which create the crosshatch pattern or with the resulting shape, e.g. diamond, square, and the like, provided that there is a change in reflective angle present. Similarly, depending on the spacing of the embossed dots, the color variations may be aligned with the dots themselves or with the spacing between the dots, again, providing that there is a change in reflective angle present.

Figure 8:
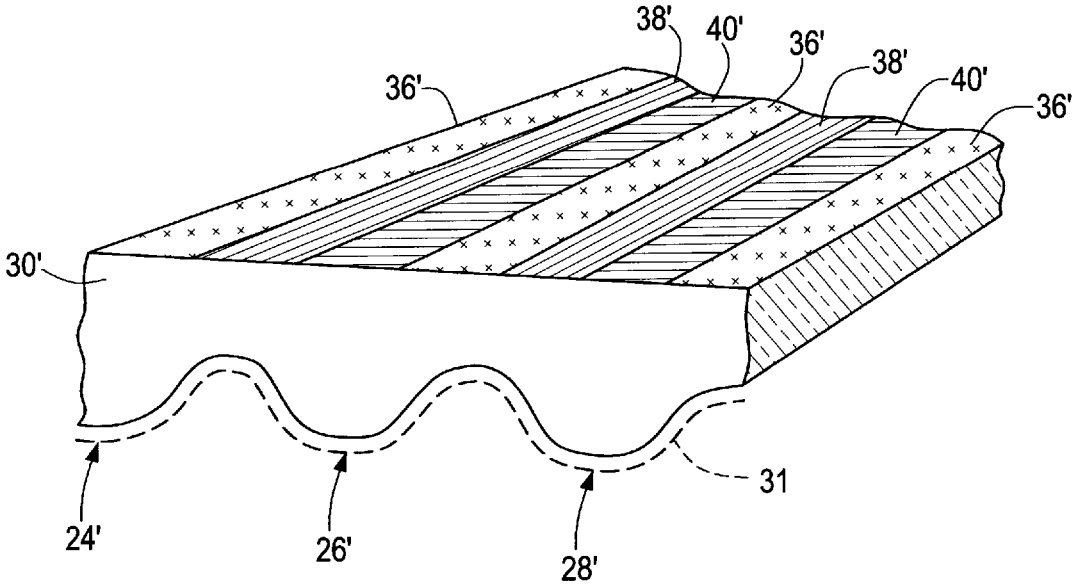
FIG. 8 is an enlarged schematic view, similar to FIG. 3, in which a translucent medium is embossed with grooves on one side and color variations printed on the other to selectively subdue and reveal color variations as the viewing angle changes.

The variable color print may also be constructed from a transparent or translucent medium 30*a*, FIG. 8, which includes embossed grooves 24', 26', 28' on one side of substrate 30*a*. Yellow stripes 36', magenta stripes 38' and cyan stripes 40' are typically printed on substrate 30' on the side opposite from the embossing. Alternatively, the embossed surface may include reflective material 31, shown in phantom, which reflects light which has been transmitted through substrate 30' from a light source above the substrate back through substrate 30'.

Grooves 24', 26' and 28' vary transmissivity of substrate 30' such that colors are selectively subdued and highlighted resulting in different colors being perceived as the viewing angle changes, similar to that discussed with reference to FIG. 3. Different embossing patterns may be used as discussed with reference to FIGS. 5, 6A, 6B and 6C. Similarly, different color variation patterns as discussed with reference to FIG. 7 may be utilized according to the embossing chosen.

Figure 9:
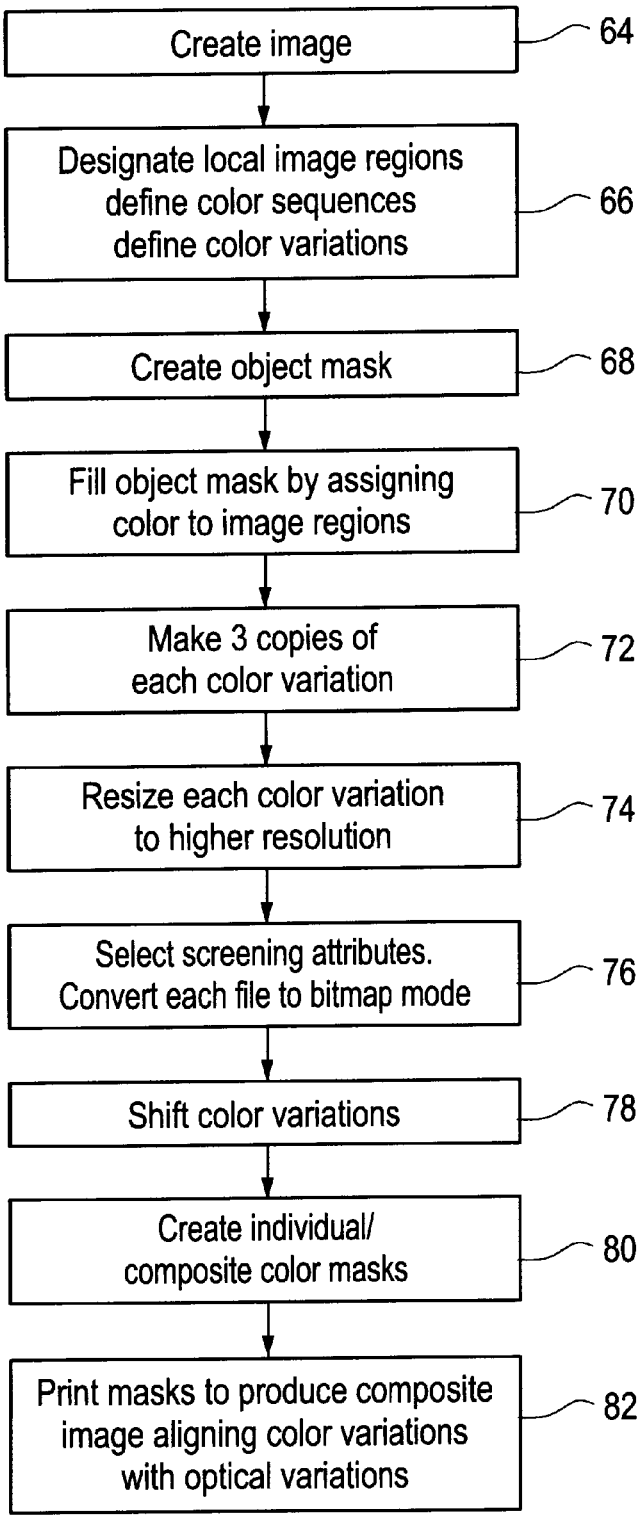
FIG. 9 is a flow diagram of the method according to this invention of printing a variable color print on an embossed medium.

One technique of forming a variable color print according to this invention consists of color casting by creating an image, step 64, FIG. 9, by scanning an image into the computer for example, and designating local image regions, step 66, to produce a composite mask. One mask for each local color assigned to the local image region is then generated, step 70. Different local image regions, 14, 16, 18 and 20, FIG. 1, can be established by standard mask procedures well known in the art and available within computer programs such as PHOTOSHOP by Adobe Systems, Inc.; CANVAS by Deneba Software and ILLUSTRATOR by Adobe Systems, Inc., each of which is commercially available.

Each mask is filled with a color, for example, magenta, red, yellow, green, cyan, or blue, step 70. However, the masks are not limited to the above colors and may be filled with any color combinations. Moreover, six masks are not required, but as few as two masks may be created.

Three copies of each individual color variation (yellow, magenta, cyan) are made, step 72, and each individual color file is saved in the grayscale mode. Each of the three copies is re-sized, step 74, to a higher resolution (e.g. 600–2400 dpi), depending on the available computer memory. Each of the nine files, three files for each color, is converted to the bitmap mode using a halftone screen method known in the art. The print screening attributes, e.g. crosshatch pattern, straight line pattern, dot pattern, alignment angle, lining frequency, etc., are chosen, step 76, at the time the files are converted to the bitmap mode. Each of the nine files is converted back to the grayscale mode for editing.

The different color variations are then shifted, step 78. The position of one the three cyan color variation files is shifted to the left a distance of approximately one third the total line spacing of the chosen frequency. For example, a straight line frequency of one hundred lines per inch produces a line spacing of 0.01, one third of which is 0.00333. One of the yellow color variation files and one of the magenta color variation files is shifted in the same manner. Similarly, one copy each of the yellow, magenta and cyan files is shifted to the right in the same manner. The remaining three files are unchanged.

A composite of each color variation is individually made, step 80, using the appropriate color mask to import the properly shifted image into the final composite image. Each mask is then printed, step 82, such that the color variations which make up the local colors are properly aligned with the image medium at the correct frequency to produce the composite variable color image which changes color as the viewing angle changes.

Figure 10:
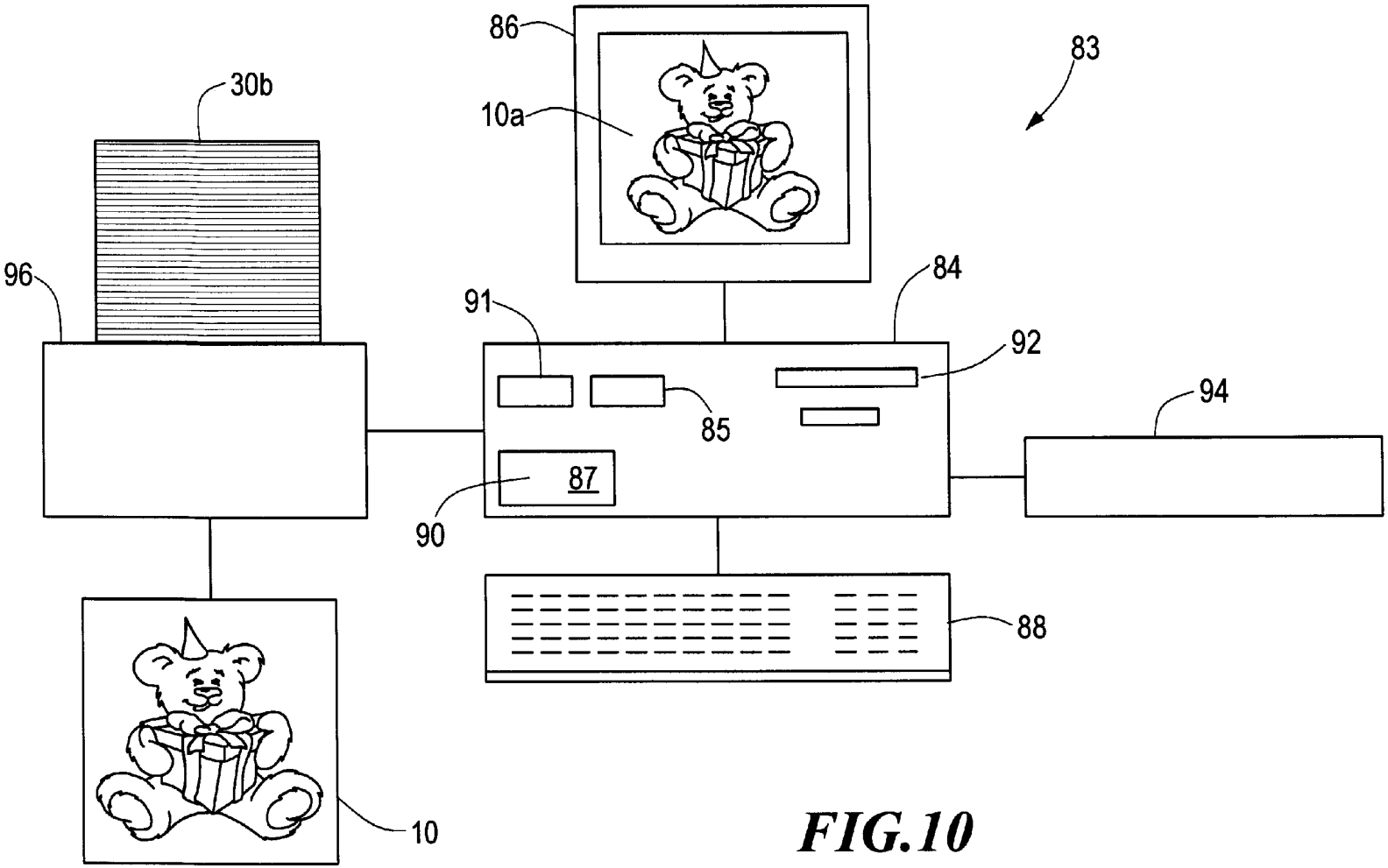
FIG. 10 is a schematic view of a variable color print printing system according to this invention.

System 83, FIG. 10, for printing such a variable color print may include computer 84, which has a microprocessor 85 with sufficient clock speed, typically 200–300 MHz, to run software 87 discussed above, stored on hard drive 90. Similarly, computer 84 must also have sufficient hard drive memory 90 and random access memory (RAM) 91, to be able to run software 87, typically 200 megabytes of hard drive space and 64–750 megabytes of RAM. System 83 also includes monitor 86 for viewing the image to be printed, and keyboard 88 for entering printing parameters.

Image 10*a* may be selected from a pre-existing data base stored on hard drive 90, or downloaded from disk drive 92 which may include CD or floppy disk drives. Alternatively, the image may be scanned into computer 84 using color scanner 94. Once the image is edited and prepared using the desired software, sheet stock 30*b*, such as the reflective image medium as discussed above and available from RJM Graphics, Middleboro, Mass., is loaded into color printer 96 or a printing press, not shown, well known in the art. Image 10*a* is then printed onto stock 30*b* to produce variable color print 10.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A variable color print of an image comprising:

a reflective image medium including a plurality of different, locally colored, image regions;

a first plurality of repeated changes in reflective angle of said image medium which extend in a first direction and are parallel to each other in a second direction transverse to said first direction;

each locally colored image region including at least one local color medium disposed on said reflective medium;

each said local color medium including at least one color sequence, each said sequence extending in said second direction and including at least two different color variations; and each said color variation aligned with said repeated changes in reflective angle such that said repeated changes in reflective angle selectively prevent viewing of at least one of said color variations and selectively highlight at least one of said color variations at different viewing angles to generate changes in color of said locally colored image regions as the viewing angle changes.

2. The variable color print of claim 1 in which said color variations are aligned within said locally colored image regions for providing at least two different colors, each in a different locally colored image region, visible for each viewing angle.

3. The variable color print of claim 2 in which said repeated changes in reflective angle prevent viewing of said two different colors at a different viewing angle and enable viewing of two other colors.

4. The variable color print of claim 1 in which said image medium includes a substrate and reflective material disposed on said substrate.

5. The variable color print of claim 1 in which said repeated changes in reflective angle include undulations in the reflective surface of said image medium.

6. The variable color print of claim 5 in which said undulations are oriented in the same direction for each said image region.

7. The variable color print of claim 6 in which said undulations are generally sinusoidal.

8. The variable color print of claim 5 in which said repeated variations in color are disposed on said undulations of the reflective surface.

9. The variable color print of claim 5 in which said undulations include a plurality of grooves established in said reflective surface.

10. The variable color print of claim 5 in which said undulations include a plurality of raised, semi-spherical dots.

11. The variable color print of claim 5 in which said undulations are substantially regularly spaced.

12. The variable color print of claim 1 in which said color variations are regular in at least two of said locally colored image regions.

13. The variable color print of claim 1 in which at least two repeated variations in color are associated with each repeated change in reflective angle.

14. The variable color print of claim 1 in which said reflective image medium includes at least 65 repeated reflective changes per inch.

15. The variable color print of claim 14 in which said reflective image medium includes 100 to 300 repeated reflective changes per inch.

16. The variable color print of claim 1 in which said different locally colored image regions represent different intensities of the image.

17. The variable color print of claim 1 further including a second plurality of repeated changes in reflective angle of said image medium which extend in a third direction transverse to said first direction and are parallel to each other in a fourth direction transverse to said second direction.

18. The variable color print of claim 17 in which said third direction is perpendicular to said first direction.

19. The variable color print of claim 17 in which said repeated changes in reflective angle include undulations in the reflective surface of said image medium.

20. The variable color print of claim 19 in which said undulations include a plurality of raised, semi-spherical dots.

21. A variable color print of an image comprising:

a reflective image medium including a plurality of different, locally colored, image regions;

a first plurality of repeated changes in reflective angle of said image medium which extend in a first direction and are parallel to each other in a second direction transverse to said first direction;

a second plurality of repeated changes in reflective angle of said image medium which extend in said second direction and are parallel to each other in said first direction transverse to said second direction;

each locally colored image region including at least one local color medium disposed on said reflective medium;

each said local color medium including at least one color sequence, each said sequence including at least two different color variations, each color variation extending in said first and second directions; and at least one of said color variations aligned with said repeated changes in reflective angle such that said repeated changes in reflective angle selectively prevent viewing of at least one of said color variations and selectively highlight at least one of said color variations at different viewing angles to generate changes in color of said locally colored image regions as the viewing angle changes.

22. A variable color print of an image comprising:

a translucent image medium including a plurality of different, locally colored, image regions;

a first plurality of repeated changes in transmissivity of said image medium which extend in a first direction and are parallel to each other in a second direction transverse to said first direction;

each locally colored image region including at least one local color medium disposed on said translucent image medium;

each said local color medium including at least one color sequence, each said sequence extending in said second direction and including at least two different color variations; and each said color variation aligned with said repeated changes in transmissivity such that said repeated changes in transmissivity selectively prevent viewing of at least one of said color variations and selectively highlight at least one of said color variations at different viewing angles to generate changes in color of said locally colored image regions as the viewing angle changes.

23. The variable color print of claim 22 in which said color variations are aligned within said locally colored image regions for providing at least two different colors, each in a different locally colored image region, visible for each viewing angle.

24. The variable color print of claim 23 in which said repeated changes in transmissivity prevent viewing of said two different colors at a different viewing angle and enable viewing of two other colors.

25. The variable color print of claim 22 in which said image medium includes a transmissive substrate and reflective material disposed on said substrate.

26. The variable color print of claim 22 in which said repeated changes in transmissivity include undulations in the translucent surface of said image medium.

27. The variable color print of claim 26 in which said undulations are oriented in the same direction for each said image region.

28. The variable color print of claim 27 in which said undulations are generally sinusoidal.

29. The variable color print of claim 26 in which said undulations include a plurality of grooves established in said translucent surface.

30. The variable color print of claim 26 in which said undulations include a plurality of raised, semi-spherical dots.

31. The variable color print of claim 26 in which said undulations are substantially regularly spaced.

32. The variable color print of claim 26 in which at least two repeated variations in color are associated with each repeated change in transmissivity.

33. The variable color print of claim 26 in which said repeated variations in color are disposed on said undulations of the translucent surface.

34. The variable color print of claim 22 in which said color variations are regular in at least two of said locally colored image regions.

35. The variable color print of claim 22 in which said translucent image medium includes at least 65 repeated transmissivity changes per inch.

36. The variable color print of claim 35 in which said translucent image medium includes 100 to 300 repeated transmissivity changes per inch.

37. The variable color print of claim 22 in which said different locally colored image regions represent different intensities of the image.

38. The variable color print of claim 22 further including a second plurality of repeated changes in transmissivity of said image medium which extend in a third direction and are parallel to each other in a fourth direction transverse to said second direction.

39. The variable color print of claim 38 in which said third direction is perpendicular to said first direction.

40. The variable color print of claim 38 in which said repeated changes include undulations in the translucent surface of said image medium.

41. The variable color print of claim 40 in which said undulations include a plurality of raised, semi-spherical dots.

42. A variable color print of an image comprising:

a reflective image medium including a plurality of different, locally colored, image regions;

a first plurality of repeated changes in reflective angle of said image medium which extend in a first direction and are parallel to each other in a second direction transverse to said first direction;

each locally colored image region including at least one local color medium disposed on said reflective medium;

each said local color medium including at least one color sequence, said sequence including a first color variation extending in said first direction and aligned with said repeated changes in reflective angle and a second color variation extending transverse to said first color variation such that said repeated changes in reflective angle selectively prevent viewing of at least a portion of said color variations and selectively highlight at least a portion of said color variations at different viewing angles to generate changes in color of said locally colored image regions as the viewing angle changes.

43. A variable color print of an image comprising:

a translucent image medium including a plurality of different, locally colored, image regions;

a first plurality of repeated changes in transmissivity of said image medium which extend in a first direction and are parallel to each other in a second direction transverse to said first direction;

each locally colored image region including at least one local color medium disposed on said translucent image medium;

each said local color medium including at least one color sequence, each said sequence including a first color variation extending in said first direction and aligned with said repeated changes in transmissivity and a second color variation extending transverse to said first color variation such that said repeated changes in transmissivity selectively prevent viewing of at least a portion of said color variations and selectively highlight at least a portion of said color variations at different viewing angles to generate changes in color of said locally colored image regions as the viewing angle changes.

44. A method of printing a variable color print comprising:

designating local image regions of an image;

defining at least two different colors, each color including at least two color sequences, each sequence including at least two different color variations including a first color variation extending in a first direction and a second color variation extending in a second direction transverse to said first direction;

assigning the colors to the local image regions; and printing the color sequences assigned to the local image regions onto an embossed medium having a plurality of repeated changes in reflective angle or transmissivity which extend in said second direction and are parallel to each other in said first direction transverse to said second direction, each said color variation aligned with said repeated changes in reflective angle or transmissivity such that said repeated changes in reflective angle or transmissivity selectively prevent viewing of at least one of said color variations and selectively highlight at least one of said color variations at different viewing angles to generate changes in color of said local image regions as the viewing angle changes.

* * * * *